United States Patent [19]

Adkins

[11] Patent Number: 4,800,822

[45] Date of Patent: Jan. 31, 1989

[54] GUN SAFE WITH EJECTABLE DRAWER

[76] Inventor: John Adkins, 1955 New Berlin Rd., Jacksonville, Fla. 32218

[21] Appl. No.: 917,050

[22] Filed: Oct. 9, 1986

[51] Int. Cl.[4] ..... E05B 7/32

[52] U.S. Cl. ..... 109/19; 109/59 R; 312/311; 312/319

[58] Field of Search ..... 312/333, 311, 319; 206/317, 523; 292/DIG. 4; 109/59 R, 19

[56] References Cited

U.S. PATENT DOCUMENTS

| | | | |
|---|---|---|---|
| 1,724,408 | 8/1929 | Miller | 312/311 |
| 3,290,106 | 12/1966 | Wilson | 312/319 |
| 3,904,259 | 9/1975 | Hoffmann | 312/319 |
| 4,446,900 | 5/1984 | Markovich | 206/317 |
| 4,466,537 | 8/1984 | McMahan | 206/317 |
| 4,492,418 | 1/1985 | Bailey | 312/311 |
| 4,531,639 | 7/1985 | Zopf | 206/317 |

FOREIGN PATENT DOCUMENTS

| | | | |
|---|---|---|---|
| 719892 | 11/1966 | Italy | 206/317 |

*Primary Examiner*—Robert L. Wolfe

*Attorney, Agent, or Firm*—Dominik, Stein, Saccocio, Reese, Colitz & VanDerWall

[57] ABSTRACT

A gun safe having an ejectable drawer is disclosed. The gun safe comprises a door hingedly connected to the opened end of a housing. The drawer is reciprocatingly mounted within the housing and is springloaded to bear against the closed door so that, upon opening of the door, the ejectable drawer is forced outwardly to present the firearm contained therein for easy grasping.

7 Claims, 2 Drawing Sheets

GUN SAFE WITH EJECTABLE DRAWER

BACKGROUND OF THE INVENTION

1. Field of the Invention

This invention relates to safes for guns and related articles. More particularly, this invention relates to gun safes having a concealable design with means for quickly gaining access to the gun stored in the gun safe.

2. Description of the Background Art

Presently there exist many types of safes designed to safely store articles therein in safe keeping from unwanted intrusion or burglary. Most safes comprise a heavy walled framed enclosure and a similar heavy walled door positioned for enclosure over the opened end of the enclosure. These types of safes are quite secure in storing the articles contained therein from burglary; however, such degree of security normally inhibits quick and easy access to the articles safely stored in the safe.

Quick and easy access to articles stored in the safe does not usually present a problem in most applications. However, when storing firearms, it is sometimes desirable to obtain quick and easy access to the firearm, particularly in emergency situations by police officers and other security professionals. Unfortunately, safes designed to store firearms usually comprise the basic safe design discussed above having a number of gun racks positioned therein. While the gun racks allow the firearms to be stored in the safe in a convenient, organized manner, such safes still suffer from the difficulty of gaining access to them by authorized personnel. An object of this invention is to provide an apparatus which overcomes the aforementioned inadequacies of the prior art devices and provides an improvement which is a significant contribution to the advancement of the gun safe art.

Another object of this invention is to provide a safe particularly designed to securely store a firearm therein to prevent access thereto by unauthorized personnel.

Another object of this invention is to provide a gun safe for storing a gun while allowing authorized personnel quick and convenient access to the stored guns as necessary.

Another object of this invention is to provide a gun safe having an ejectable drawer in which it has stored the gun safe and which ejects itself partly from the safe upon opening of the door to the safe by authorized personnel.

Another object of this invention is to provide a gun safe having an ejectable drawer which may be hidden in a concealed condition in a vehicle, desk, or the like, while allowing quick access to the gun stored therein during an emergency situation.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the Invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a safe particularly designed for storing a firearm in a safe condition and accessible by unauthorized personnel for later extigent use by authorized personnel such as police officers and other security professionals. More particularly, the gun safe of the invention comprises a generally rectangular housing having one end opened. A door is hingedly connected to the front edge of the opening to the safe and includes a lock mechanism for securely retaining the door in a locked position about the opening of the housing.

A spring-loaded drawer is reciprocatingly mounted within the housing by means of a pair of drawer slides or the like. A catch mechanism is provided for Releasably securing the drawer within the housing against the force of the springs. The catch mechanism is actuated by the closing of the door.

During use, a firearm, such as a pistol, is placed in the drawer of the safe and the drawer is closed against the force of the spring until it is retained fully within the housing by means of the catch mechanism. The door of the housing is then closed where upon the catch mechanism is triggered. However, since the door is now closed, the spring-loaded drawer now bears against the inner surface of the door by the force of the spring. When an emergency situation arises, the police officer simply unlocks the lock mechanism of the door. The door is immediately forced open by the force of the spring-loaded drawer, and then the drawer is immediately ejected from the housing allowing the police officer to quickly grasp the weapon contained therein.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
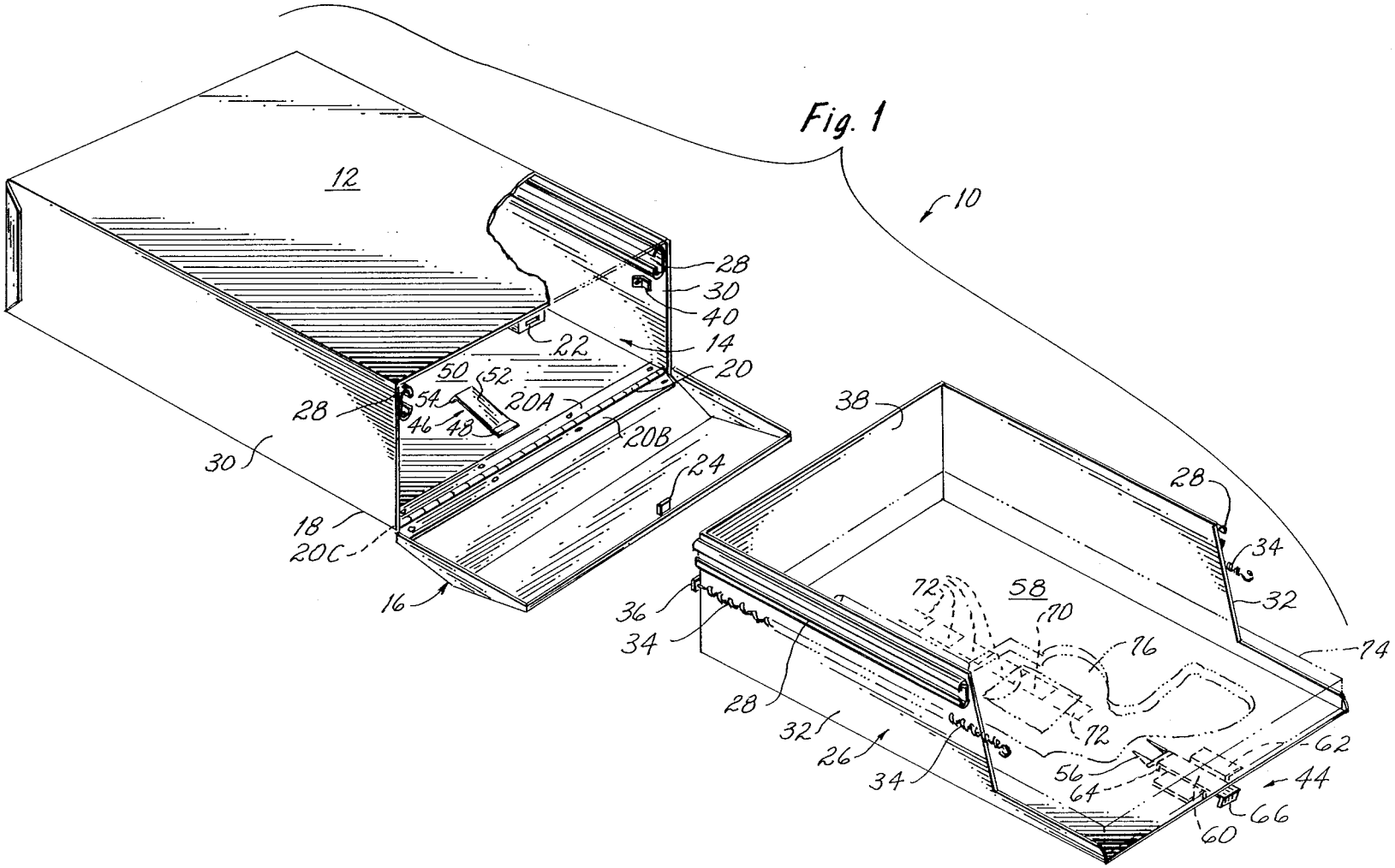
FIG. 1 is an exploded view of the gun safe of the invention illustrating a spring-loaded gun drawer which is reciprocatingly mounted within a safe enclosure and actuated by the door of the safe.

Referring to FIG. 1, the gun safe 10 of the invention comprises a generally rectangular housing 12 having an opened front portion or doorway 14. A door 16 is hingedly connected to the lower edge 18 of the opening 14 by means of a piano type hinge 20 or the like. The leaves 20A and 20B of the hinge are rigidly fastened to the interior of the housing 12 and the door 16 to conceal the hinge pin 20C thereof from tampering from the outside of the housing 12. A lock mechanism, generally indicated by the numeral 22, cooperates with tab 24 on door 16 to securely retain the door 16 in its closed locked position about the opening 14. Although the lock mechanism 22 is illustrated schematically, it should be understood that many lock mechanisms will suffice. For example, lock mechanism 22 may comprise a key lock operable by means of a key with or without a push button release. Alternatively, lock mechanism may comprise a combination lock operable to release the door 16 immediately upon entering the last digit to the combination. Finally, a lock mechanism 22 may comprise an electro-magnetic device capable of being actuated from a remote location or in combination with another system. For example, with the gun safe 10 of the invention installed within a vehicle, the lock mechanism 22 may be remotely actuated by the driver of the vehicle.

It is also noted that while the housing 12 and door 16 are illustrated in FIG. 1 as being constructed from a single layer of material, such as steel or aircraft aluminum, it should be appreciated that the walls of the housing 12 and door 16 may comprise a laminate for added strength and security much in the same manner as conventional laminates used in the construction of safes. It shall still also be understood that the outside surface of door 16 may be made to look like a fake radio, bookend, or the like so as to conceal the gun safe 10.

Figure 2:
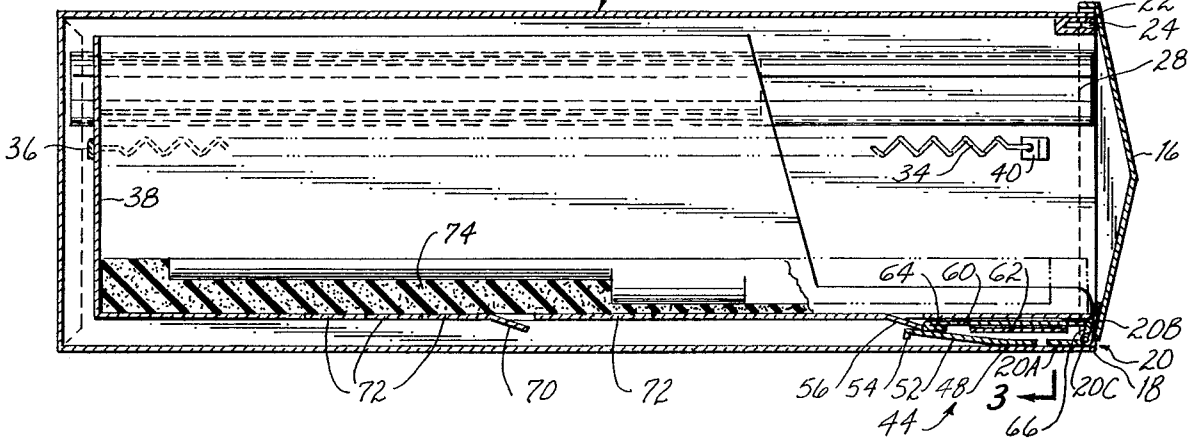
FIG. 2 is a longitudinal cross sectional view of the gun safe of the invention along lines 2—2 of FIG. 3.

Referring to FIGS. 1 and 2, the gun safe 10 of the invention further includes a drawer 26 reciprocatingly mounted within housing 12 by means of a pair of drawer slides 28 mounted on opposing sides 30 and 32 of the housing 12 and drawer 26, respectively. Slides 28 allow the drawer 26 to freely move into and out of housing 12.

Figure 3:
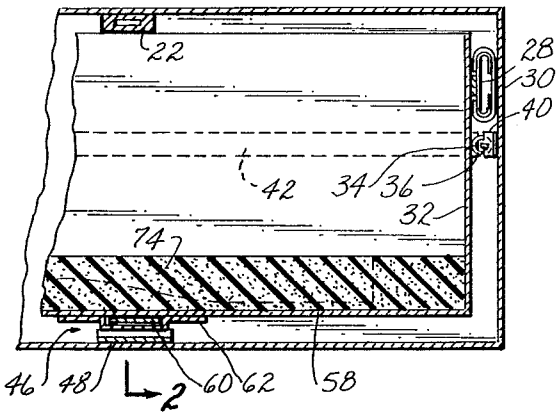
FIG. 3 is a partial cross sectional view of FIG. 2 along lines 3—3 illustrating the transverse cross sectional view of the catch mechanism.
Figure 5:
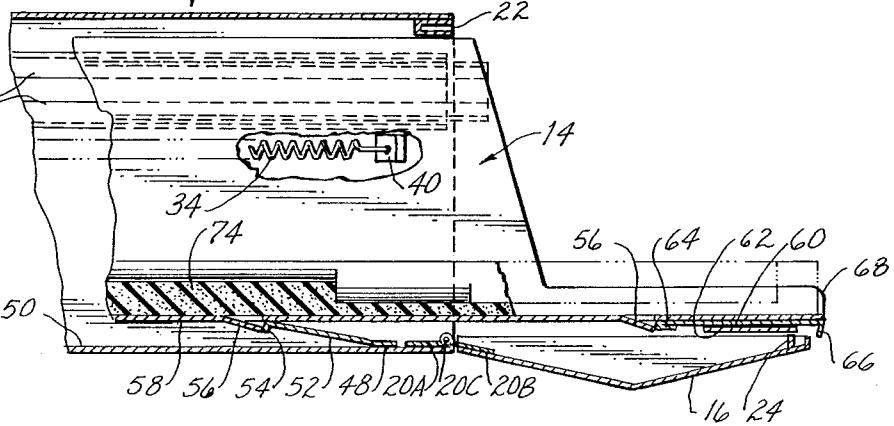
FIG. 5 is another partial longitudinal cross sectional view illustrating the drawer in its fully ejected position presenting the weapon exteriorly of the housing.
Figure 4:
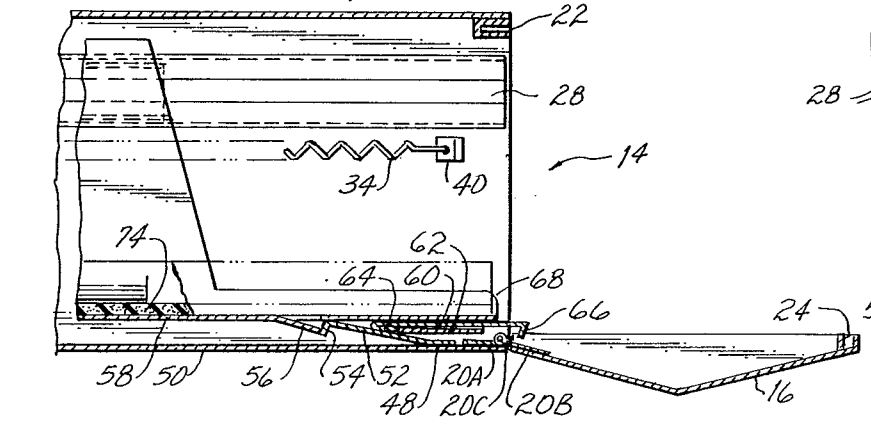
FIG. 4 is a partial longitudinal cross sectional view of the gun safe illustrating the catch mechanism restraining the drawer within the housing against the force of the spring prior to being actuated by the door of the housing.

Referring to FIG. 1 in conjunction with FIGS. 2, 4, and 5, drawer 26 is spring-loaded within housing 12 by means of tension spring connected between tab 36 affixed to the rear of 38 of drawer 26 and tab 40 affixed to the forward portion of the side 30 of housing 12. With such an arrangement positioned between both sides 30 of the housing 12 and the sides 32 of the drawer 26, it should be apparent that the drawer 26 is constantly urged outwardly from within the housing 12. Further, it is noted that the tabs 36 extending from opposing sides of the rear 38 of the drawer 26 may comprise a single bar 42 (see FIG. 3) extending fully across the rear of 38 of drawer 26.

A catch mechanism, generally indicated by numeral 44, is provided to retain the drawer 26 in a retracted position within housing 12 against the force of springs 34 until door 16 can be closed about the opened end 14 of the housing 12. More particularly, catch mechanism 44 comprises leaf 46 having a base portion 48 rigidly affixed to the floor 50 of the housing 12 by welding or the like. Leaf 46 further comprises an upstanding portion 52 having a down turned edge 54. Leaf 46 is manufactured from a resilent material, such as spring steel, such that the upstanding portion 52 is urged upwardly from the floor 50 of the housing 12.

The catch mechanism 44 further comprises a down turned tab 56 extending from the floor 58 of the drawer 26 for engagement by the upstanding portion 52 of leaf 46 (see FIG. 4). Thus, when the drawer 26 is fully retracted within housing 12 against the force of springs 34, the upstanding portion 52 of the leaf 46 catches the down turned tab 56 of the drawer 26 thereby holding the drawer 26 within the housing 12 against the force of spring 34.

Finally, catch mechanism 44 still further comprises the trigger 60 designed to disengage leaf 46 from down turned tab 56 thereby releasing the drawer 26. Specifically, trigger 60 comprises a relatively flat design secured to the underside of floor 58 by means of a generally U-shaped bracket 62. Thus, trigger 60 is allowed to reciprocate within bracket 62 in a longitudinal direction relative to drawer 26. The rear edge 64 of trigger 60 is curved over upon itself for a smooth engagement with leaf 46. Further, the forward edge 66 of the trigger 60 is downwardly turned for engagement by the inner surface of door 16.

Referring to FIG. 4 in comparison with FIG. 2, it is apparent that enclosure of door 16 forces its inner surface in engagement with the forward edge 66 of trigger 60 and slides trigger 60 rearwardly within bracket 62 to progressively engage the upstanding portion 52 of leaf 46 and force it downwardly to release the drawer 26. However, by the time the trigger 60 has been forced sufficiently rearwardly to disengage leaf 46 from down turn tab 46, door 16 is closed and, upon locking the lock mechanism 22, secures the drawer 26 within the housing 12. Hence, the front edge 18 rests against the inner surface of the door 16 until door 16 is opened.

Upon opening of the door 16, force exerted by springs 34 force the drawer 26 outwardly to an extended position. However, a down turn tab extends from the floor 58 of the drawer 26 and is caught by the upstanding portion 52 of leaf 46 thereby preventing drawer 26 from being fully ejected from the housing 12. As shown in FIG. 1, down turn tab 70 may be formed from one of several punched tabs 72 formed in the floor 58 of the drawer 26. Hence, the degree by which the drawer 26 extends from the housing 12 can be readily altered by utilizing another punched tab 72 positioned rearwardly or forwardly of tab 70.

As shown in phantom in FIG. 1, a contoured Styrofoam ® or other lining 74 may be positioned within the drawer 26 to correspond to the outer configuration of the weapon 76 to be stored therein. The contoured lining 74 functions to prevent shifting of the firearm 76 during transport of the safe 10 movement of the drawer 26 into and out of the housing 12.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A safe for storing articles such as a firearm, comprising in combination:

a housing having walls and a floor defining an opened end;

a drawer having a floor for positioning within said housing;

means for reciprocatingly mounting said drawer within said housing;

means for urging said drawer outwardly from within said housing;

a door;

means for connecting said door to said opened end of said housing; and a catch mechanism for securing said drawer within said housing until closure of said door, said catch mechanism including:

a leaf extending from said floor of said housing, a down turned tab extending from said floor of said drawer in longitudinal alignment with said leaf for engagement by said leaf when said drawer is retracted within said housing, trigger, and means for reciprocatingly securing said trigger relative to said floor in longitudinal alignment with said leaf and in engageable alignment with said door, whereby, upon closure of said door, said trigger engages said leaf causing said leaf to disengage said down turned tab;

whereby said catch mechanism secures said drawer within said housing until closure of said door whereupon said drawer is urged against said door and is ejected form said housing upon opening of said door.

2. The safe as set forth in claim 1, further including a stop tab extending from said floor of said drawer for engagement by said leaf to limit the outward extensible travel of said drawer from said housing.

3. The safe as set forth in claim 2, wherein said urging means comprises a pair of springs positioned on the opposing sides of said drawer having one end connected to said drawer and another end connected to said housing to urge said drawer outwardly from within said housing to an extended position.

4. The safe as set forth in claim 1, wherein said drawer includes a contoured lining positioned therein corresponding to the configuration of the article to be stored within the safe to preclude shifting of the article upon movement of said drawer relative to said housing.

5. The safe as set forth in claim 4, wherein said configuration of said lining comprises the configuration of a pistol.

6. The safe as set forth in claim 1, wherein said drawer includes a cutout portion allowing easy access to the article stored therein,

7. The safe as set forth in claim 1, wherein said housing and said door are manufactured from aircraft aluminum.

* * * * *